United States Patent [19]

Gager

[11] 4,109,937

[45] Aug. 29, 1978

[54] DONOR SHEET FOR THERMOGRAPHIC IMAGING PROCESS

[75] Inventor: Morgan E. Gager, Warwick, R.I.

[73] Assignee: Trans World Technology Laboratories, Inc. (TWT Labs Inc.), Fiskeville, R.I.

[21] Appl. No.: 653,955

[22] Filed: Jan. 30, 1976

[51] Int. Cl.[2] ..... B41L 1/20; B41M 5/18; G03C 5/16

[52] U.S. Cl. ..... 282/27.5; 250/316; 427/56; 427/145; 427/146; 427/147; 427/150; 427/261; 428/480; 428/483; 428/913

[58] Field of Search ..... 282/27.5; 428/913, 483, 428/537, 480; 8/2.5, 2.5 A; 250/317, 319; 427/145, 146, 150, 261, 56

[56] References Cited

U.S. PATENT DOCUMENTS

| | | | |
|---|---|---|---|
| 2,663,656 | 12/1953 | Miller et al. | 428/913 X |
| 2,910,377 | 10/1959 | Owen | 428/913 |
| 3,111,584 | 11/1963 | Appeldorn | 250/319 |
| 3,442,682 | 5/1969 | Fukawa | 428/537 |
| 3,483,013 | 12/1969 | Berg et al. | 428/913 X |
| 3,594,208 | 7/1971 | Wiese et al. | 428/483 |
| 3,666,525 | 5/1972 | Kimura et al. | 282/27.5 |
| 3,695,912 | 10/1972 | Di Laurentis et al. | 8/2.5 |
| 3,788,875 | 1/1974 | Schutzner | 427/145 X |
| 3,911,171 | 10/1975 | Janssens et al. | 427/145 |
| 3,988,501 | 10/1976 | Knirsch et al. | 428/913 |
| 4,004,065 | 1/1977 | Matsushita et al. | 428/913 X |

*Primary Examiner*—Thomas J. Herbert, Jr.
*Attorney, Agent, or Firm*—Birch, Stewart, Kolasch and Birch

[57] ABSTRACT

An acid donor sheet for use in thermographic imaging which comprises a substrate sheet material having a coating comprising an organic acid which is volatilizable at thermographic imaging temperatures, an additive consisting essentially of a fatty acid having from 10 to 26 carbon atoms or a metal salt thereof, and a polymeric binder compatible with said volatilizable acid. A preferred composition is salicylic acid, lauric acid and nitrocellulose on a polyester base. The acid donor sheet of the invention is particularly useful in providing color projection transparencies having improved image density, readability, and permanence.

22 Claims, 1 Drawing Figure

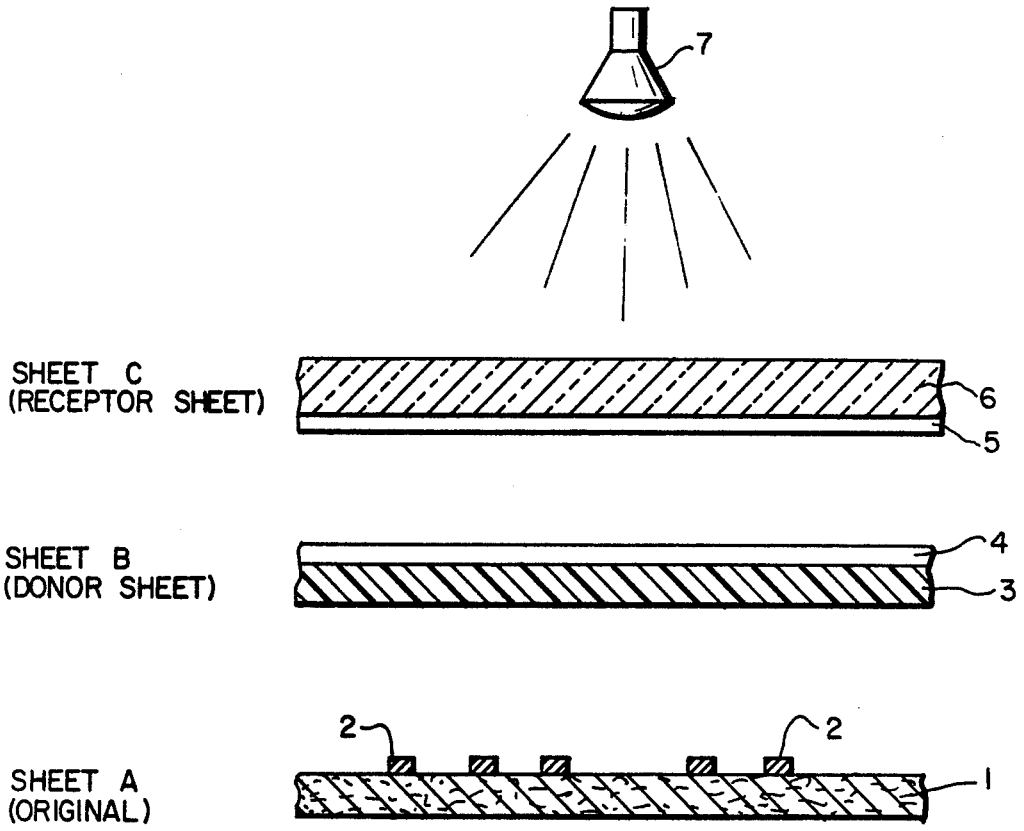
7
SHEET C
(RECEPTOR SHEET)
6
5
SHEET B
(DONOR SHEET)
4
3
2
2
SHEET A
(ORIGINAL)
1

DONOR SHEET FOR THERMOGRAPHIC IMAGING PROCESS

This invention relates to a donor sheet for use in thermographic imaging. More particularly, the invention relates to a donor sheet containing certain fatty acids or fatty acid salts in combination with a heat volatilizable organic acid which, when heated at infrared-absorbing image areas in the presence of a receptor sheet containing a protonatable chromogeneous dye-forming color progenitor, forms a sharp, dense, permanent image corresponding to the original on the receptor sheet.

Overhead projectors, for example as described in U.S. Pat. No. 3,126,786, are widely used in classrooms as teaching aids or in meetings for demonstrations and the like. Projection from transparency reproductions of printed or pictorial originals is convenient and greatly enhances communications and an understanding of the material being projected. Black-and-white transparencies have been easily and quickly prepared by thermographic copying techniques, for example, by the method as described in U.S. Pat. No. 3,111,584.

Thermographic processes for making color projection transparency copies of printed originals have also been described in the prior art. Some of these processes involve subjecting a source sheet to a heat pattern, i.e., as obtained by brief exposure of the differentially radiation-absorptive printed original to intense infrared radiation, to cause transfer of coloring matter from the source sheet to a contacting receptor sheet at the heated areas. Other methods of heating the source sheet at image areas may be employed, but the thermographic process is both fast and convenient.

Transparencies for the projection of images in color have been produced thermographically using color source and receptor sheets employing transferable dyes. In these processes, the entire quantity of dye forming the transparent colored image must be transferred from the source sheet to the receptor sheet; however, such transfer is frequently inadequate to provide full-color images of massive printed areas such as are occasionally present in demonstration drawings and figures.

Heat sensitive copy sheets are known which change color, when thermographically heated, through a dye-forming reaction between a dye-forming chromogenous electron donor material and an organic acid, such as salicylic acid or benzoic acid. The process of thermographic imaging utilizing a two-sheet system based upon this mechanism to form color transparencies or images on film supports is exemplified by U.S. Pat. No. 3,483,013 of Berg et al, U.S. Pat. No. 3,695,912 of DeLaurentis et al and British patent 1,204,567. In the two-sheet thermographic imaging process as shown in the accompanying drawing, an original sheet (A) carrying infrared radiation-absorbing images is superposed with a volatilizable acid-containing donor sheet (B) and a dye-precursor receptor sheet (C) in which both the donor and receptor sheets are infrared transmitting. Infrared radiation is applied to induce selective heating of the original images which causes the acid in the heated portions of the donor sheet to volatilize and penetrate the receptor sheet and to react with the dye precursor, thereby forming a copy of the original sheet.

Although the donor sheets described in the state-of-the-art produce imagery in the prescribed manner, they suffer generally from uneven and poor penetration of the acid into the receptor sheet which leaves acid crystals on the surface of the image layer. Thus, the reaction between the acid and the color progenitor is incomplete.

While the acid crystals on the image-layer surface project to give an initially dense image due to their light scattering effect, they vaporize away in time to leave a weak and incompletely-formed image. Moreover, the normal examination or reading of the projectual during projection is difficult due to the light-scattering caused by the small acid crystals.

Accordingly, one of the objects of the present invention is to provide an acid donor sheet for use in thermographic imaging which overcomes the disadvantages of the prior art, namely, the problems of image mottle, impermanent imagery, and poor readability, particularly in connection with the preparation of color projection transparencies.

Another object of the invention is to provide an acid donor sheet composition which gives an enhanced image density when used in thermographic imaging.

These and other objects and advantages of the present invention will become apparent to those skilled in the art from a study and consideration of the following specification and claims, taken in conjunction with the accompanying drawing which schematically shows a two-sheet system as employed in the thermographic imaging process pursuant to the invention.

In accordance with the present invention, it has been found that the use of certain fatty acids or fatty acid salts in combination with a heat volatilizable organic acid in the donor sheet serves to control the physical nature of the acidic layer and the subsequent volatility of the acid, thereby providing a composition which produces sharp, easily readable, permanent, and dense images, when employed with an appropriate receptor sheet in the thermographic imaging procedure.

The FIGURE illustrates an acid donor sheet B in accordance with the invention wherein element 3 is a base substrate material, such as a polyester film, having an acid layer 4 thereon, said acid layer containing a volatilizable acid and, in accordance with the invention, a fatty acid or fatty acid salt, and a polymeric binder. The acid layer suitably has a thickness of from about 0.03 to 0.3 mil, depending on the particular formulation employed. However, the significant factor is that there be sufficient acid present in the donor sheet to react with the dye precursor in the receptor sheet to form the desired images.

A typical receptor sheet C is shown in the accompanying drawing, wherein a dye layer 5 is disposed on a substrate base material 6, such as a polyester film. Advantageously, the receptor sheet has the structure and formulation of the receptor sheet described in U.S. Pat. No. 3,502,871 of Marx et al, the disclosure of which is expressly incorporated herein.

In practice, the donor sheet B and receptor sheet C, or composite, are placed in face-to-face contact, i.e., acid layer 4 is contacted with dye layer 5 and an image is reflexively formed by passing the composite through a thermal imaging machine having an infrared radiation lamp 7, with the donor sheet substrate 3 in contact with the original image areas 2 which are supported on substrate 1 of sheet A. A divider sheet can be used between composites or assemblies in packaging as an interleaving sheet to facilitate the removal of each composite from the package.

Heat volatilizable acids such as salicylic acid, benzoic acid and 5-chlorosalicylic acid may typically be used in the donor sheet. Salicylic acid is preferred since it is capable of volatilizing readily from the donor sheet to the receptor sheet at normal thermal imaging temperatures (about 125°–175° C) to form the desired image thereon. In general, organic acids having a pKa of from 2 to 5 are employed.

The binder preferably employed for the volatilizable organic acid is nitrocellulose, such as Hercules Nitrocellulose SS. Other suitable polymeric binders include Eastman Chemical Products Alcohol Soluble Propionate, Union Carbide's Bakelite VAGH (a partially hydrolyzed vinyl chloride-vinyl acetate copolymer), Hercules Parlon S (chlorinated isoprene rubber), Dow Ethyl Cellulose, and General Mills Milvex Nylon. The binder is selected so that the acid layer is non-tacky in the non-image areas, and permits ready volatilization of the organic acid at thermal imaging temperatures. A tacky layer can create a problem of transfer to the non-image areas in the receptor sheet, thereby potentially causing undesirable background color formation. The concentration of the binder can range between 10 to 150% of the weight of the acid. A pigment is preferably employed in the acid donor sheet layer formulation to assist in achieving good coating uniformity and to help eliminate transfer of the acid layer to the non-image areas of the receptor sheet during imaging. Acid layer transfer in the non-image areas is also minimized by the selection of binders with softening temperatures that are higher than the melting point of the acid.

The gist of the present invention, however, resides in the use of a fatty acid or fatty acid salt in combination with the heat volatilizable organic acid in the donor sheet. The function of the fatty acid or fatty acid salt is to control the crystallization of the acid, thereby making it more readily volatilizable. This higher rate of volatilization provides greater thermal thrust to the acid so that it more fully penetrates into the dye precursor layer, thereby ensuring a complete reaction. A finer crystal and more readily volatilizable form of the organic acid, such as salicylic acid, is obtained, resulting in more effective formation of the image. This produces sharper, more easily readable and more permanent images, as well as higher image densities. Table 1 illustrates the increase in density achieved by the addition of fatty acids or fatty acid salts to the donor sheet in accordance with the invention.

TABLE 1

| Additive | Density |
|---|---|
| None | .75 |
| Zinc stearate | .83 |
| Aluminum palmitate | .98 |
| Aluminum laurate | .99 |
| Zinc palmitate | .95 |
| Zinc oleate | .92 |
| Stearic acid | .91 |
| Palmitic acid | .98 |
| Myristic acid | .99 |
| Lauric acid | .97 |
| Oleic acid | .88 |
| Lithium stearate | .90 |

The above results were obtained using 1.74 parts by weight of the additive in addition to salicylic acid and nitrocellulose in accordance with the procedure described in Example 1 below. Densities were read with a MacBeth TD 518 Transmission Densitometer using a visual filter.

The preferred additive is lauric acid. Generally, saturated and unsaturated fatty acids having from 10 to 26 carbon atoms can be advantageously employed, such as stearic acid, myristic acid, behenic acid, palmitic acid, capric acid, linoleic acid, oleic acid, etc. Metallic stearates, such as zinc stearate, aluminum stearate, lithium stearate, barium stearate, potassium stearate, calcium stearate, tin stearate, magnesium stearate and cadmium stearate, may also be employed with advantage. Other additives found to be useful in accordance with the invention are metal salts of other fatty acids such as aluminum palmitate, zinc palmitate, zinc oleate and aluminum laurate. Generally, the metallic salts comprise fatty acid salts of metals of Groups IA, IIA, IIIA, IVA, IB, IIB, VIIB and VIII of the Periodic Table. An optimal range of concentration of fatty acid or fatty acid salt additive is from about 5 to 50% by weight of the volatilizable acid in the formulation. However, the upper limit is not critical for the formation of image and is only limited by practical considerations depending on the choice of the additive such as cost, coating rheology, etc.

For the production of color transparencies, the substrate base of the donor sheet must be essentially transparent to infrared radiation. Many sheet materials have this property, such as polyesters, polystyrene, polycarbonates, polysulfones, glassine, etc. One-half mil polyester sheet is advantageous since it provides a good balance between rigidity on the one hand, and thermal conductivity, on the other hand. The organic acid to be heat volatilized to the receptor sheet is disposed thereon together with the fatty acid or fatty acid salt additive in a suitable binder.

The base substrate in the receptor sheet can be any infrared transmitting and visually transparent material such as, polystyrene, polycarbonates, polyesters, polysulfones, cellulose acetate, however, a polyester base sheet is also advantageous as with the donor sheet. The dye precursor components contained in the receptor sheet can be any of those known and used in the prior art such as disclosed in U.S. Pat. No. 3,502,871. Examples from said patent of such dye-forming chromogenous electron donor components, which are colorless or weakly colored in a non-acid state but are strongly colored when treated with a volatilizable acid, are listed in Table II.

TABLE II

| Dye | | Alkalizing agent | Image color |
|---|---|---|---|
| Commercial name | C.I. Designation | | |
| Victoria Green B Base. | Solvent Green 1 | None | Green. |
| Rhodamine BI Base. | Solvent Red 49 | " | Magenta. |
| Methyl Green | Basic Blue 20 | KOH | Blue-Green. |
| Auramine Base | Solvent Yellow | None or KOH | Yellow. |
| Methyl Violet Base | Solvent Violet 8 | KOH | Purple. |
| Ethyl Violet | Basic Violet 4 | KOH | Blue-Violet. |
| Sandocyl Red B4G | Basic Red 14 | KOH | Red. |
| Sandocyl Red B3B | Basic Red 15 | KOH | Red. |
| Sandocyl Yellow B6GL. | Basic Yellow 13 | KOH | Yellow. |
| Sandocyl Blue B6G | Basic Blue 1 | KOH | Blue. |
| Magenta ABN Conc. | Basic Violet 2 | KOH | Magneta. |
| Of the listed dyes, the following combinations produce additional colors | | | |
| Auramine Base / Methyl Violet Base | | KOH | Black |
| Auramine Base / Rhodamine BI | | KOH | Orange |

TABLE II-continued

| Dye | | Alkalizing agent | Image color |
|---|---|---|---|
| Commercial name | C.I. Designation | | |
| Base | | | |
| By including in the coating a dye not sensitive to color change by the process, tinted backgrounds are obtained. An example of this is: | | | |
| Auramine Base<br>Victoria Green B Base<br>Rhodamine BI Base | | None | Black |
| Azosol Fast Red BE. | Solvent Red 8 | | To give light red background color |

While the acid donor sheet is designed primarily for use with leuco dye color precursors, it is applicable to any infrared imaging process, which is based on a pH change. For example, a negative working projectual system may be obtained by the use of a dye layer on a polyester film wherein the dye is rendered colorless by an acid.

The following Examples are given merely as illustrative of the present invention and are not to be considered as limiting. Unless otherwise indicated, the amounts of ingredients therein are by weight.

EXAMPLE 1

An acid donor sheet is prepared by applying to one surface of 0.5 mil polyester film the following solution using a No. 8 wire wound rod and drying at 70° C so that the dry weight is 1.1 pounds per 3000 square feet:

Methanol: 30.10 parts by weight
Toluene: 3.53 parts by weight
10% SS grade nitrocellulose in methanol: 51.35 parts by weight
Salicylic acid: 12.75 parts by weight
Zinc stearate: 1.74 parts by weight
Syloid 72: 0.53 parts by weight A receptor sheet was prepared by coating a 3 mil polyester film with 15% of Acryloid A-10 (a resin having a high concentration of polymethylmethacrylate polymers and a low concentration of polyethylacrylate) and 2% of a dye precursor, such as Victoria Green B (Solvent Green 1), dissolved in a solvent system containing by volume 15% of methyl ethyl ketone, 50% of ethylene glycol monomethyl ether and 35% of ethylene glycol monoethyl ether. The coating was applied with a No. 10 wire wound rod which resulted in a dry coating thickness of 0.0001 to 0.0002 inch.

The donor and receptor sheets are placed in face-to-face contact on a printed original so that the donor sheet is in contact with the original. This composite is exposed to infrared radiation in a thermal imaging machine (3M Secretary) for a time sufficient to produce a strongly colored green image in the receptor sheet coating.

EXAMPLE 2

Example 1 is repeated using the following formula for the acid donor sheet:

Methanol: 30.10 parts by weight
Toluene: 3.53 parts by weight
10% SS grade nitrocellulose in methanol: 51.35 parts by weight
Salicylic acid: 12.75 parts by weight
Zinc stearate: 1.74 parts by weight An image similar to Example 1 is obtained.

EXAMPLE 3

Example 1 repeated using the following formula for the acid donor sheet:

Methanol: 19.90 parts by weight
Toluene: 3.53 parts by weight
10% SS grade nitrocellulose in methanol: 61.55 parts by weight
Salicylic acid: 12.75 parts by weight
Lauric acid: 2.09 parts by weight An image similar to Example 1 is obtained.

EXAMPLE 4

Example 1 is repeated using the following formula for the acid donor sheet:

Methanol: 19.90 parts by weight
Toluene: 3.53 parts by weight
10% SS grade nitrocellulose in methanol: 61.55 parts by weight
5-Chlorosalicylic acid: 15.92 parts by weight
Lauric acid: 2.09 parts by weight An image similar to Example 1 is obtained.

EXAMPLE 5

Example 1 is repeated, except that benzoic acid is substituted for salicylic acid and the following formula is used for the acid donor sheet:

Methanol: 30.10 parts by weight
Toluene: 3.53 parts by weight
10% SS grade nitrocellulose in methanol: 51.35 parts by weight
Benzoic acid: 11.30 parts by weight
Zinc stearate: 1.74 parts by weight
Syloid 72: 0.53 parts by weight An image similar to Example 1 is obtained.

EXAMPLE 6

The procedure of Example 1 is repeated using aluminum laurate in place of zinc stearate so that the following formula is used for the acid donor sheet:

Methanol: 30.10 parts by weight
Toluene: 3.53 parts by weight
10% SS grade nitrocellulose in methanol: 51.35 parts by weight
Salicylic acid: 12.75 parts by weight
Aluminum laurate: 1.74 parts by weight
Syloid 72: 0.53 parts by weight An image similar to Example 1 is obtained.

EXAMPLE 7

The procedure of Example 1 is repeated using lithium stearate in place of zinc stearate so that the following formula is used for the acid donor sheet:

Methanol: 30.10 parts by weight
Toluene: 3.53 parts by weight
10% SS grade nitrocellulose in methanol: 51.35 parts by weight
Salicylic acid: 12.75 parts by weight
Lithium stearate: 1.30 parts by weight
Syloid 72: 0.53 parts by weight An image similar to Example 1 is obtained.

EXAMPLE 8

The procedure of Example 1 is repeated using lauric acid in place of zinc stearate so that the following formula is used for the acid donor sheet:

Methanol: 19.90 parts by weight
Toluene 3.53 parts by weight
10% SS grade nitrocellulose in methanol: 61.55 parts by weight
Salicylic acid: 12.75 parts by weight
Lauric acid: 2.09 parts by weight
Syloid 72: 1.06 parts by weight An image similar to Example 1 is obtained.

EXAMPLE 9

The procedure of Example 1 is repeated using 5-chlorosalicylic acid in place of salicylic acid and lauric acid in place of zinc stearate so that the following formula is used for the acid donor sheet:

Methanol: 19.90 parts by weight
Toluene: 3.53 parts by weight
10% SS grade nitrocellulose in methanol: 61.55 parts by weight
5-chlorosalicylic acid: 15.92 parts by weight
Lauric acid: 2.09 parts by weight
Syloid 72: 1.06 parts by weight An image similar to Example 1 is obtained.

EXAMPLE 10

The procedure of Example 1 is repeated using oleic acid in place of zinc stearate so that the following formula is used for the acid donor sheet:

Methanol: 30.10 parts by weight
Toluene: 3.53 parts by weight
10% SS grade nitrocellulose in methanol: 51.35 parts by weight
Salicylic acid: 12.75 parts by weight
Oleic acid: 1.74 parts by weight
Syloid 72: 0.53 parts by weight An image similar to Example 1 is obtained.

EXAMPLE 11

The procedure of Example 1 is repeated using palmitic acid in place of zinc stearate so that the following formula is used for the acid donor sheet:

Methanol: 30.10 parts by weight
Toluene: 3.53 parts by weight
10% SS grade nitrocellulose in methanol: 51.35 parts by weight
Salicylic acid: 12.75 parts by weight
Palmitic acid: 1.74 parts by weight
Syloid 72: 0.53 parts by weight An image similar to Example 1 is obtained.

EXAMPLE 12

The procedure of Example 1 is repeated using Eastman Chemical Products' Alcohol Soluble Propionate in place of nitrocellulose and lauric acid in place of zinc stearate so that the following formula is used for the acid donor sheet:

Methanol: 70.00 parts by weight
Toluene: 3.53 parts by weight
Alcohol Soluble Propionate: 6.16 parts by weight
Salicylic acid: 12.75 parts by weight
Lauric acid: 2.09 parts by weight
Syloid 72: 1.06 parts by weight An image similar to Example 1 is obtained.

EXAMPLE 13

The procedure of Example 1 is repeated using Type N Ethyl Cellulose (22 cps grade) in place of nitrocellulose, benzoic acid in place of salicylic acid, and the lauric acid additive in place of zinc stearate so that the following formula is used for the acid donor sheet:

Methanol: 74.40 parts by weight
Toluene: 3.53 parts by weight
Ethyl Cellulose, Type N, 22 cps: 6.16 parts by weight
Benzoic acid: 11.30 parts by weight
Lauric acid: 2.09 parts by weight
Syloid 72: 1.06 parts by weight An image similar to Example 1 is obtained.

EXAMPLE 14

The procedure of Example 1 is repeated using Union Carbide's Bakelite VAGH in place of nitrocellulose, benzoic acid in place of salicylic acid, and the lauric acid additive in place of zinc stearate so that the following formula is used for the acid donor sheet:

Methyl ethyl ketone: 78.00 parts by weight
Bakelite VAGH: 6.16 parts by weight
Benzoic acid: 11.30 parts by weight
Lauric acid: 2.09 parts by weight
Syloid 72: 1.06 parts by weight An image similar to Example 1 is obtained.

The invention being thus described, it will be obvious that the same may be varied in many ways. Such variations are not to be regarded as a departure from the spirit and scope of the invention, and all such modifications are intended to be included within the scope of the following claims.

I claim:

1. An acid donor sheet for use in thermographic imaging which comprises a substrate sheet material which is transparent to infrared radiation having a coating thereon comprising an organic acid having a $pK_a$ of from 2 to 5, said organic acid being capable of volatilizing at thermal imaging temperatures of up to about 175° C., a fatty acid additive having from 10 to 26 carbon atoms or a metal salt thereof, said additive being present in an amount sufficient to control the crystallization and rate of volatilization of said organic acid, and a polymeric binder for said organic acid.

2. An acid donor sheet in accordance with claim 1, wherein said organic acid is salicylic acid.

3. An acid donor sheet in accordance with claim 1, wherein said fatty acid additive is lauric acid.

4. An acid donor sheet in accordance with claim 1, wherein said binder is nitrocellulose.

5. An acid donor sheet in accordance with claim 1, wherein the amount of said additive present in the donor sheet is from about 5 to 50% of the weight of said organic acid.

6. An acid donor sheet for use in thermographic imaging which comprises a substrate, sheet material which is transparent to infrared radiation and which has an acid-containing coating disposed thereon comprising salicylic acid, a fatty acid additive having from 10 to 26 carbon atoms or a metal salt thereof and a nitrocellulose binder.

7. An acid donor sheet in accordance with claim 6, wherein said substrate is a polyester film.

8. An acid donor sheet in accordance with claim 6, wherein said additive is a saturated fatty acid.

9. An acid donor sheet in accordance with claim 8, wherein said additive is lauric acid.

10. An acid donor sheet in accordance with claim 9, wherein said substrate is a polyester film.

11. An infrared radiation transmitting assembly for producing an imaged transparency corresponding to an imaged original sheet in a thermographic process, which comprises an acid donor sheet and a receptor sheet which is receptive to the acid in said donor sheet and reactive therewith to form colored images corresponding to the images on the original sheet, said acid donor sheet comprising a substrate sheet material which is transparent to infrared radiation having a coating thereon comprising an organic acid having a $pK_a$ of from 2 to 5 and which is volatilizable at thermal imaging temperatures of up to about 175° C., a fatty acid additive having from 10 to 26 carbon atoms or a metal salt thereof, and a polymeric binder for said organic acid, and said receptor sheet comprising a clear, infrared-transmitting plastic film carrying a coating comprising a substantially colorless acid-sensitive dye precursor which develops an intense color upon reaction with said acid.

12. The assembly of claim 11, wherein the fatty acid additive in the acid donor sheet is lauric acid.

13. The assembly of claim 11, wherein said donor substrate sheet material and said clear plastic film in the receptor sheet are both polyester films.

14. The assembly of claim 11, wherein said organic acid is salicylic acid and said binder is nitrocellulose.

15. The assembly of claim 14, wherein said fatty acid additive is lauric acid and wherein said donor substrate sheet material and said clear plastic film in the receptor sheet are polyester films.

16. The assembly of claim 14, wherein the amount of said fatty acid or fatty acid salt additive present in the donor sheet is from about 5 to 50% of the weight of said organic acid.

17. A thermographic process for producing a copy of an imaged original sheet on a receptor film by means of infrared radiation which comprises superposing the original sheet in intimate surface contact with an assembly as defined in claim 11, the acid donor layer being in contact with the dye precursor layer of the receptor sheet, exposing said superposed sheets to a source which emits infrared radiation to heat the original images and the corresponding areas of the assembly to cause the organic acid in the acid donor sheet to volatilize and penetrate the dye precursor layer of the receptor sheet, whereby the organic acid reacts with the dye precursor in said areas to form an intensely colored dye, and separating the acid donor sheet and the receptor sheet to provide transparency film having intensely colored dye image areas corresponding to the image areas of the original sheet.

18. The process of claim 17, wherein the fatty acid additive in the acid donor sheet is lauric acid.

19. The process of claim 17, wherein the substrate sheet material of both the acid donor sheet and the receptor sheet are polyester films.

20. The process of claim 17, wherein the organic acid is salicylic acid and the binder is nitrocellulose.

21. The process of claim 20, wherein the fatty acid additive in the acid donor sheet is lauric acid and the substrate sheet material of both the acid donor sheet and the receptor sheet are polyester films.

22. The process of claim 20, wherein the amount of fatty acid said additive present in the donor sheet is from about 5 to 50% of the weight of said organic acid.

* * * * *